US007040809B2

(12) United States Patent
Pokusa

(10) Patent No.: US 7,040,809 B2
(45) Date of Patent: May 9, 2006

(54) FASTENER CLOSURE ARRANGEMENT FOR FLEXIBLE PACKAGES

(75) Inventor: Kenneth C. Pokusa, Indian Head Park, IL (US)

(73) Assignee: Kraft Foods Holdings, Inc., Northfield, IL (US)

( * ) Notice: Subject to any disclaimer, the term of this patent is extended or adjusted under 35 U.S.C. 154(b) by 0 days.

(21) Appl. No.: 10/975,567

(22) Filed: Oct. 28, 2004

(65) Prior Publication Data

US 2005/0123218 A1 Jun. 9, 2005

Related U.S. Application Data

(62) Division of application No. 10/260,335, filed on Oct. 25, 2002, now Pat. No. 6,884,207.

(51) Int. Cl.
*B65D 33/16* (2006.01)

(52) U.S. Cl. ..... 383/64; 24/399; 24/400

(58) Field of Classification Search ..... 383/64; 24/399–400

See application file for complete search history.

(56) References Cited

U.S. PATENT DOCUMENTS

| | | | | |
|---|---|---|---|---|
| 5,189,764 | A * | 3/1993 | Herrington et al. | 24/384 |
| 6,287,001 | B1 * | 9/2001 | Buchman | 383/64 |
| 6,364,530 | B1 * | 4/2002 | Buchman | 383/64 |
| 6,840,675 | B1 * | 1/2005 | Knight | 383/64 |
| 6,884,207 | B1 * | 4/2005 | Pokusa | 493/213 |
| 2003/0164573 | A1 * | 9/2003 | Machacek | 264/155 |
| 2005/0041891 | A1 * | 2/2005 | Ausnit et al. | 383/63 |

* cited by examiner

*Primary Examiner*—Jes F. Pascua
(74) *Attorney, Agent, or Firm*—Fitch, Even, Tabin & Flannery

(57) ABSTRACT

A flexible package is provided with a shrouded slide fastener closure. Fastener tracks are deformed at each end to provide an end stop to limit slider movement. A stop of reduced area with increased pull off force performance is provided. Features of the end stop include an L-shaped shoulder located above an underlying finger portion comprising an undeformed portion of the fastener tracks. The remainder of the end stop is formed by heating, softening and displacing portions of the fastener track material.

6 Claims, 4 Drawing Sheets

FASTENER CLOSURE ARRANGEMENT FOR FLEXIBLE PACKAGES

This is a division of prior application Ser. No. 10/280,335, filed Oct. 25, 2002 now 6,884,207 which is hereby incorporated herein by reference in its entirety.

BACKGROUND OF THE INVENTION

1. Field of the Invention

The present invention pertains to the closure of flexible packages, such as plastic bags, and in particular to fastener closures employing sliders.

2. Description of the Related Art

With the recent emphasis in providing consumers with bulk quantities of various commodities, such as food products, reclosable packages have become increasingly popular. One of the most popular means of providing reclosability is to employ zippers of various types, particularly zippers which are compatible with flexible packages of plastic film construction. Manufacturers of food products and other commodities are concerned with filling the contents of a flexible package as quickly and economically as possible. It is important that the opening provided by the fastener be made as large as practically possible. Consumers or other end users also prefer large sized openings for easy extraction of products from the package interior. Even with large openings, however, products within the package may interfere with fastener operation when product poured or otherwise dispensed from the package becomes entrained in the fastener components.

Other improvements to flexible reclosable packages are being sought. For example, when handling products comprised of numerous small pieces, such as shredded cheese or cereal, for example, it is generally desirable to have the package formed into a pouch which is open at one end, or along one side, so as to allow product to be poured or shaken through the reclosable opening. It is desirable that the product be allowed to freely flow past the reclosable opening. Preferably, the path taken by the product within the package should be made as smooth as possible.

Although improvements have been made in the art of plastic welding and joining, manufacturers of consumer products employing high speed production techniques are continually seeking improved package forming methods and equipment. Concern has been focused on the formation of stop members which limit the travel of a sliding closure traveling along fastener tracks. Any reduction in the time needed to form these and other package features can result in substantial cost savings.

SUMMARY OF THE INVENTION

It is an object of the present invention to provide a shrouded flexible package with an improved fastener closure.

Another object of the present invention is to provide reclosable packages having fastener sliders which are protected during shipment and display, and afterwards, when the package contents are poured out or otherwise extracted.

A further object of the present invention is to provide a shrouded reclosable package having improved arrangements for hanging display.

Yet another object of the present invention is to provide a shrouded reclosable plastic package having a slider fastener with improved containment of the slider in a manner which also optimizes the size of the bag opening.

A further object of the present invention is to provide a shrouded plastic bag having a slider fastener with an improved end or "crush" seal of the fastener tracks.

These and other objects of the present invention are attained in a reclosable flexible package which comprises opposed front and rear panels that have sides and are joined together to form an interior and a package opening communicating with the interior. First and second interlockable fastener tracks configurable in an interlocked, closed position and an unlocked open position. A slider that at least partly extends above the fastener tracks and is movable along fastener tracks to configure tracks in interlocked position to close the opening and to configure the fastener tracks in unlocked position to allow access through the opening to the package interior. Fastener tracks that have opposed ends located adjacent opposed sides of front and rear panels. A side seal of pre-selected width joining together one side of front and rear panels; and a stop adjacent side seal formed from an end of fastener tracks comprising an L-shaped shoulder having a portion extending above the fastener tracks and a finger-like portion lying below the shoulder.

DETAILED DESCRIPTION OF THE PREFERRED EMBODIMENTS

Figure 1:
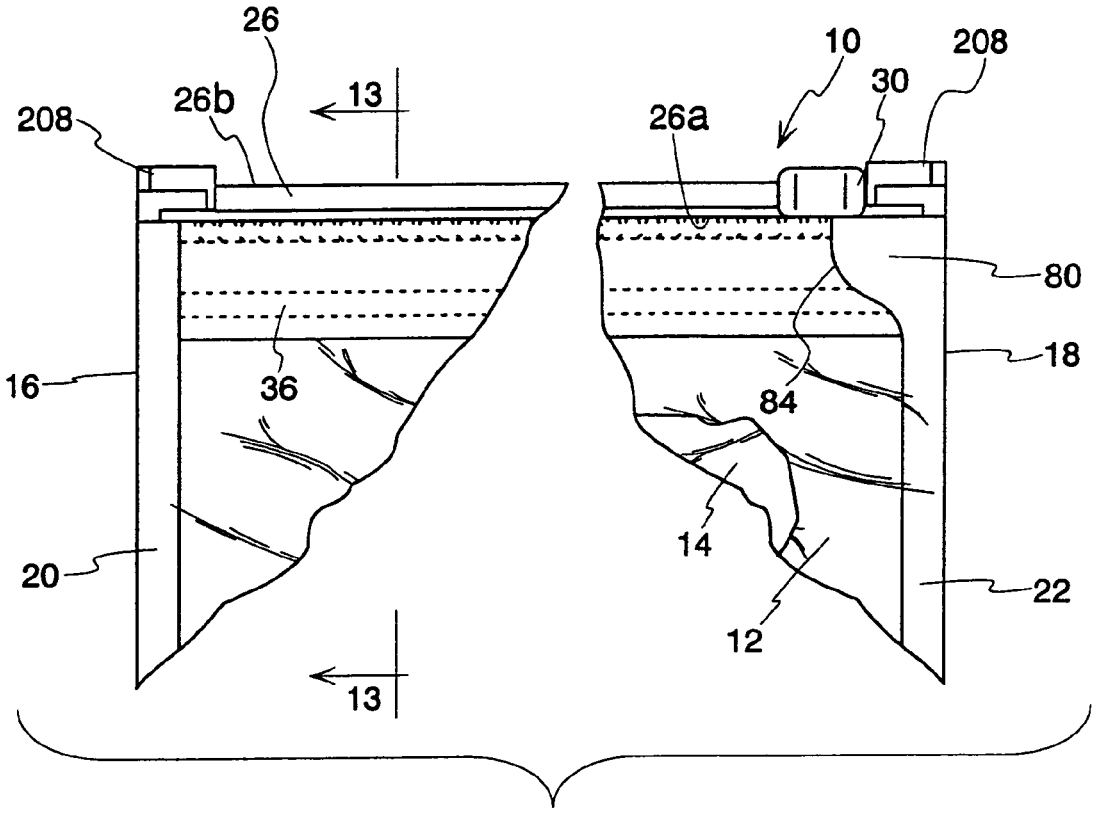
FIG. 1 is a fragmentary front elevational view of a flexible package according to principles of the present invention.
Figure 13:
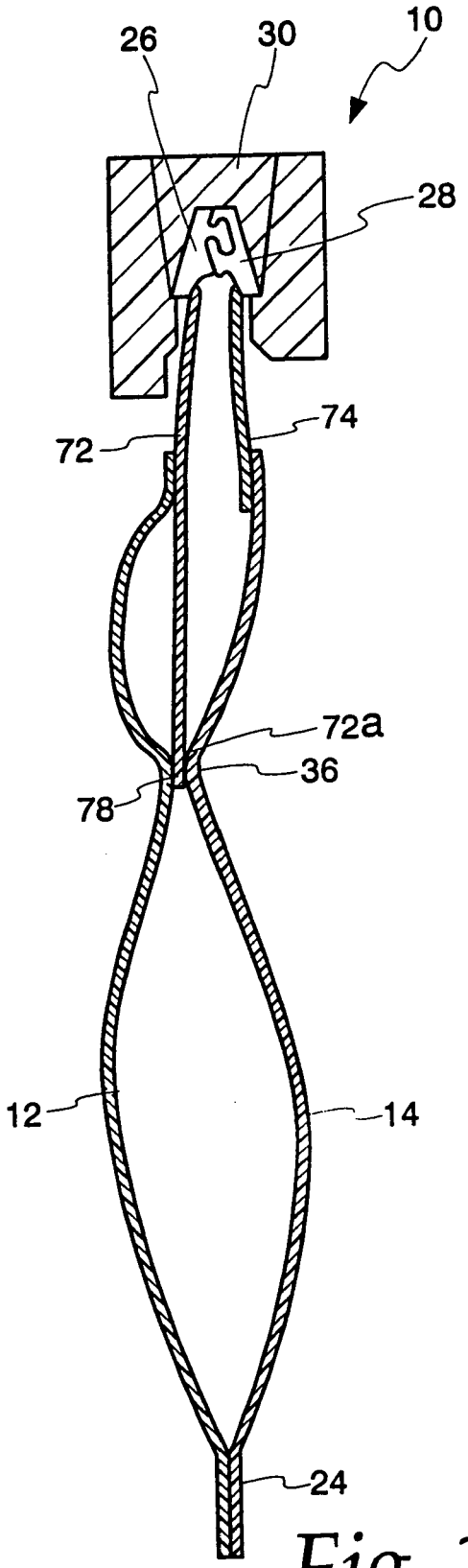
FIG. 13 is a cross-sectional view taken along the line 13—13 of FIG. 1.

Referring now to the drawings and initially to FIGS. 1 and 13, a flexible package illustrating principles of the present invention is generally indicated at 10. Flexible package 10 preferably comprises a plastic bag having front and back panels 12, 14 joined together at the left end by a side seal 20 and at the right end by a side seal 22. Side seal 20 is preferably of conventional conduction heat-sealed construction, having a generally constant width throughout. Panels 12, 14 are further joined together at their bottom ends by a bottom seal 24 (see FIG. 13) extending between side seals 20, 22, as is known in the art. Alternatively, the bottom seal can be replaced by a fold line with panels 12, 14 being formed from a continuous sheet of plastic material.

The upper end of flexible package 10 features a reclosable opening including a slide fastener arrangement with fastener tracks 26, 28 and a slider 30, all preferably of polyolefin material. The slider 30 is slidable along the fastener tracks, causing the fastener tracks to interlock or mate for closure of the flexible package and to unmate or separate to open the flexible package for access to contents in the package interior.

The flexible package according to principles of the present invention has found immediate commercial acceptance for use with food products, including perishable food products, such as cheese. Accordingly, it is generally preferred that the flexible package includes an hermetic seal 36 (see FIG. 13) in the form of a peelable seal as taught in commonly assigned U.S. Pat. Nos. 5,014,856; 5,107,658; and 5,050,736, the disclosures of which are incorporated by reference as if fully set forth herein.

As mentioned above, flexible package 10 preferably comprises a bag having panels 12, 14 formed from plastic sheet material. The sheet material can be of a single material type, such as polyolefin materials including polyethylene and polypropylene, but preferably comprises a laminate assembly of several different material types, as is known in the art to provide a barrier to moisture as well as certain gases, such as oxygen or inert fillers of the types used with food products. Other types of laminate films, such as those known in the art to preserve food freshness, may be employed. Where the contents of the flexible package are not perishable or where other considerations may dictate, the panels 12, 14 can be constructed without regard to gas or vapor barrier properties. It is generally preferred that the fastener tracks be joined to web-like flanges 72, 74 (see FIG. 3) which, in turn, are joined to panels 12, 14 as shown in FIG. 13.

Referring now to FIGS. 9–12, fastener slider 30 has a top wall 44, a shorter side wall 46 and a longer side wall 48, cooperating to define an internal cavity for receiving the fastener tracks 26, 28. As can be seen by comparing the end views of FIGS. 11 and 12, a first end 54 of the slider defines a cavity opening 50*a* which is generally rectangular. The opposed end 56 (shown in FIG. 12) defines a cavity opening which is generally arrowhead or A-shaped, as indicated by reference numeral 50*b*, conforming to the outline of the interlocked fastener tracks. When the slider 30 of FIG. 1 is moved to the right, end 56 is at the leading end of the slider and the fastener tracks 26, 28 are unlocked, thus opening the flexible package 10. Conversely, as slider 30 of FIG. 1 is moved to the left, end 54 is made the leading end, and fastener tracks 26, 28 are interlocked to close the flexible package.

Referring again to FIGS. 11 and 12, a number of features cooperate to maintain slider 30 captive on fastener tracks 26, 28. As can be seen for example in FIG. 12, a pair of upwardly facing stepped portions 62 are formed on either side of the slider cavity. Inwardly extending protrusions 64 are located at the other end of the slider. Protrusions 64 and stepped portions 62 engage the bottoms 26*a* and 28*a* (see FIG. 2) of fastener tracks 26, 28, as can be seen for example in FIG. 13. The engagement of the stepped portions 62 and the protrusions 64 with the bottoms of the fastener tracks prevents the slider from being upwardly dislocated from the fastener tracks.

Figure 15:
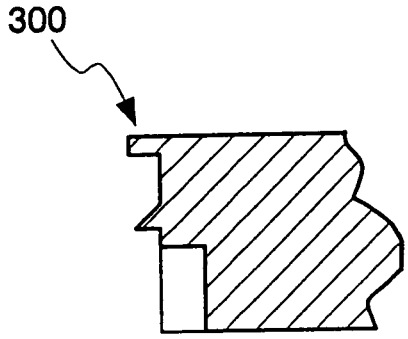
FIG. 15 is a cross-sectional view taken along the line 15—15 of FIG. 14.
Figure 14:
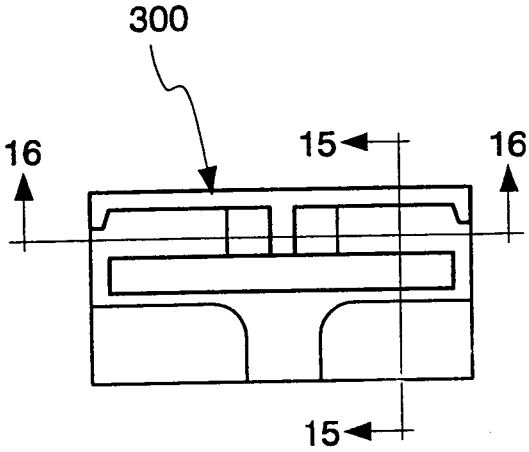
FIG. 14 is a front elevational view of an ultrasonic member for forming portions of the fastener track.
Figure 16:
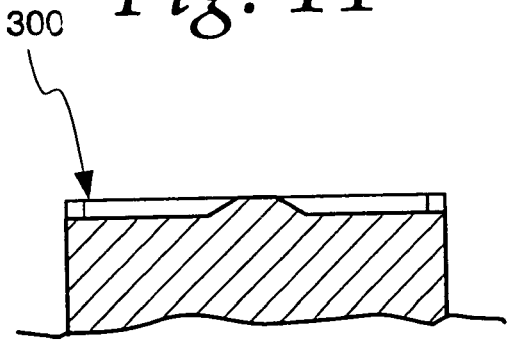
FIG. 16 is a cross-sectional view taken along the line 16—16 of FIG. 14.

Referring to FIG. 1, the ends of the of the fastener tracks are deformed or "crushed" to form stops 68. Preferably, stops 68 are formed by the application of ultrasonically generated heat and pressure to the ends of fastener tracks 26, 28 using ultrasonic horn 300 (see FIGS. 14–16). It has been found that the use of present day conduction heat sealing techniques does not provide the control needed to attain the intricate, close tolerance design of stop members according to principles of the present invention. Further, it has been found that the use of present day conduction heat sealing techniques immediately adjacent previously formed stop members tends to distort the stop members, oftentimes to an extent rendering the stop members unacceptable from a quality control standpoint.

Figure 2:
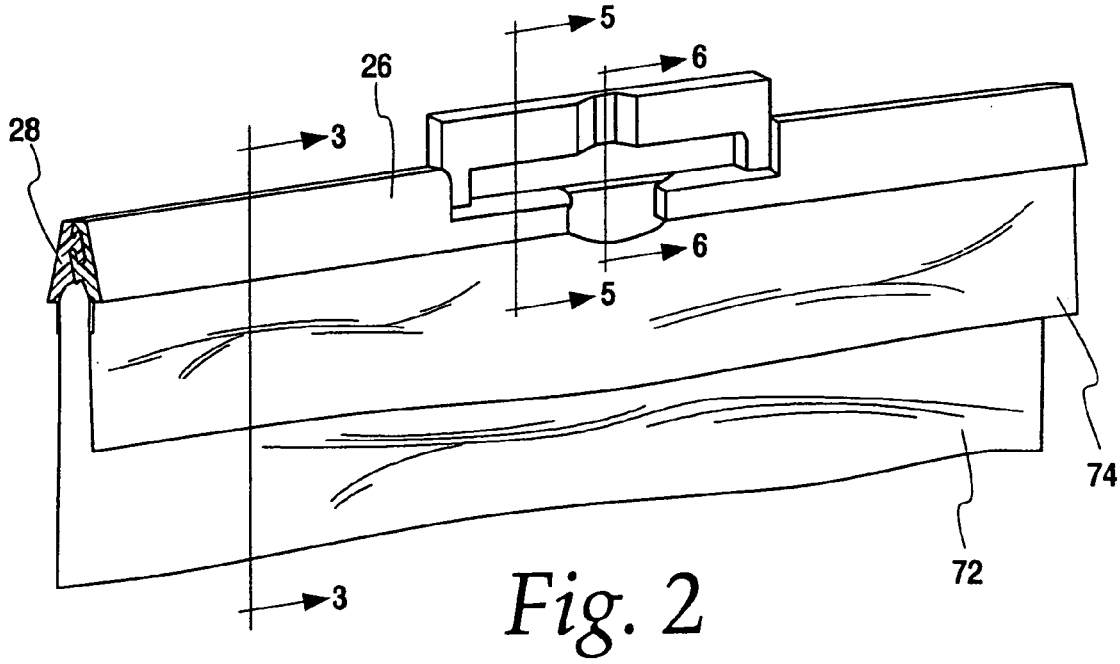
FIG. 2 is a fragmentary perspective view of a fastener track assembly according to principles of the present invention.
Figure 4:
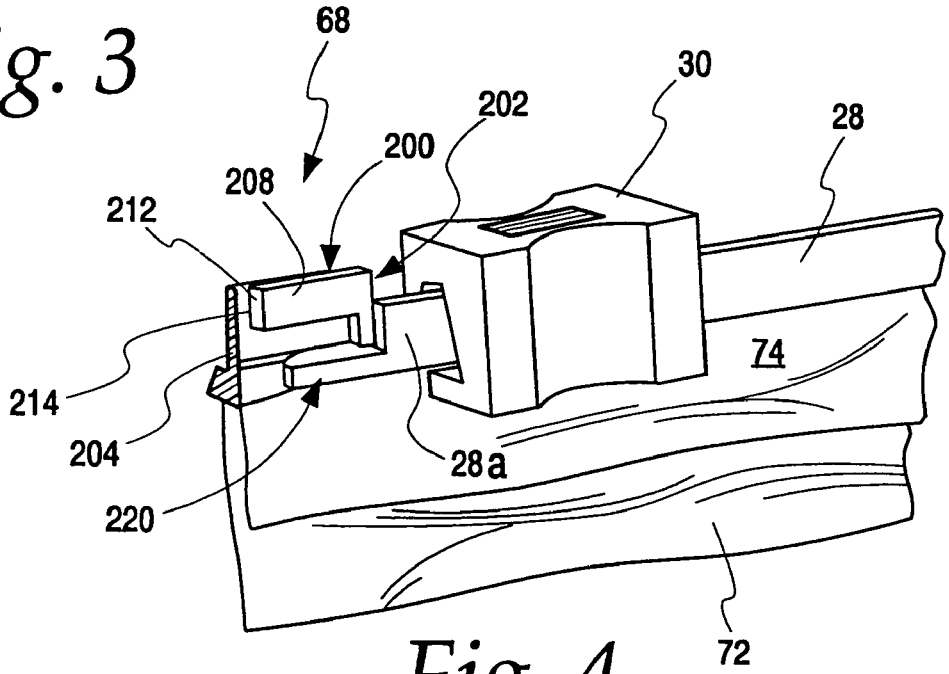
FIG. 4 is a fragmentary perspective view of a fastener track and slider assembly.

It is generally preferred that the fastener tracks 26, 28 be formed off line, that is, at a remote location and brought to the assembly point on a reel or other bulk supply. With reference to FIG. 2, for example, skirt or flange portions 72, 74 are joined to or otherwise provided with the fastener tracks 26, 28. It is generally preferred that the end stops 68 be provided at a remote location either during fabrication of the fastener tracks, or at a later point in time. As will be seen herein, the end stops 68 are formed by heating and softening, with application of pressure to displace portions of the fastener track material in a carefully defined manner shown for example in FIG. 4. Referring to FIG. 4, end stop 68 includes a generally L-shaped shoulder 200 having an inwardly facing edge 202 located opposite a cut edge 204. As shown in FIG. 4, end stop 68 has a major surface 208 which is recessed or inset from the adjacent major face 28*a* of fastener track 28. Shoulder 200 includes an end face 212 located adjacent a "fin" portion 214. With reference to FIG. 2, it is generally preferred that a pair of laterally opposed end stops be formed in a single operation and subsequently severed along line 6—6. The severing produces the cut edge 204 described in FIG. 4. It is important in many commercial applications, that the bottom portions of the fastener tracks remain undeformed. As can be seen in FIG. 4, a finger-like portion 220 underlies a major portion of the shoulder 200 and comprises the undeformed bottom portion of the fastener tracks from which shoulder 28 is formed.

Figure 5:
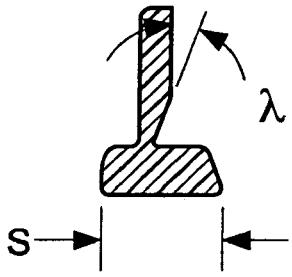
FIG. 5 is a cross-sectional view taken along the line 5—5 of FIG. 2.
Figure 6:
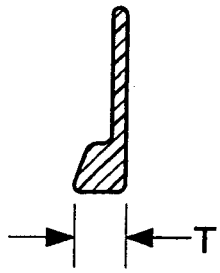
FIG. 6 is a cross-sectional view taken along the line 6—6 of FIG. 2.
Figure 7:
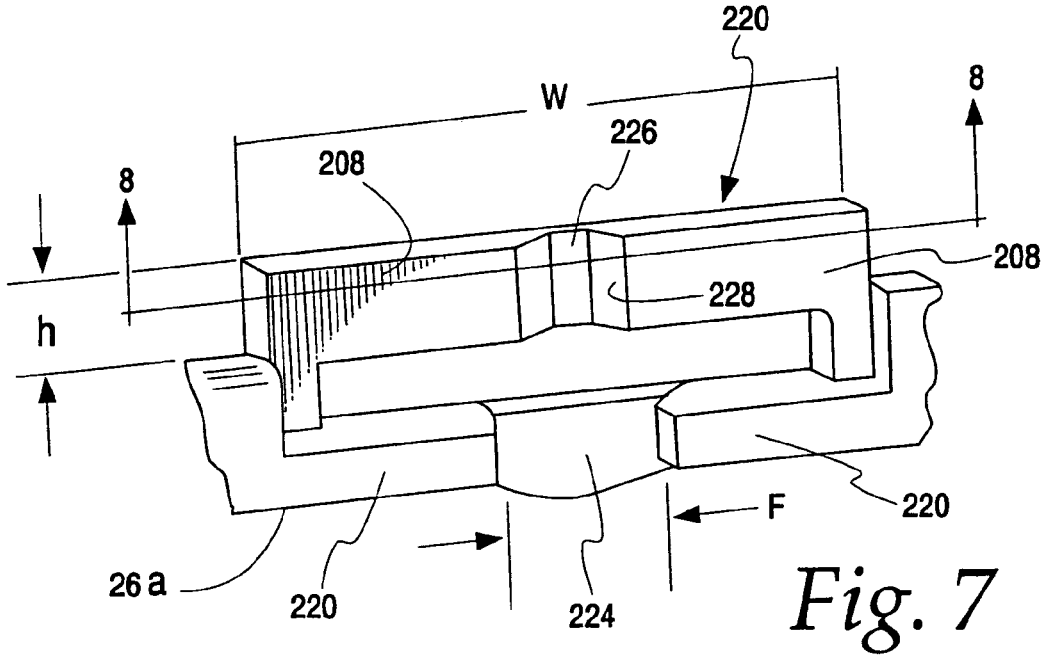
FIG. 7 shows a portion of FIG. 2 taken on an enlarged scale.
Figure 8:
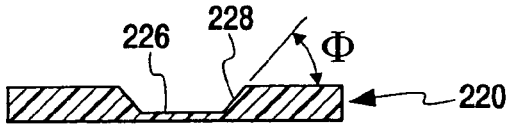
FIG. 8 is a cross-sectional view taken along the line 8—8 of FIG. 7.
Figure 9:
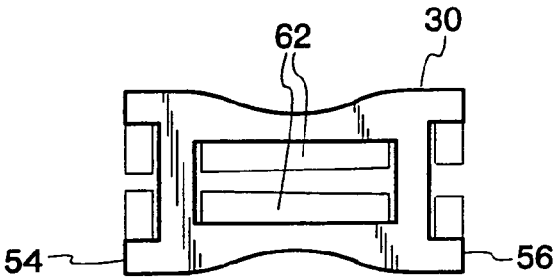
FIG. 9 is a top plan view of the slider component.
Figure 10:
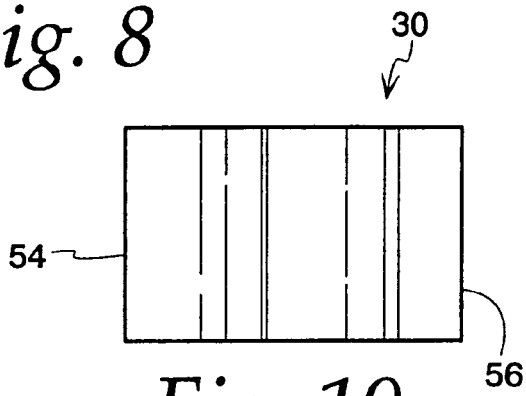
FIG. 10 is a front elevational view thereof.
Figure 11:
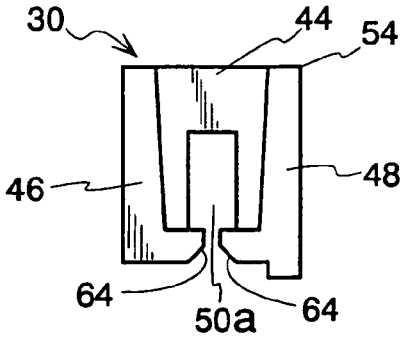
FIG. 11 is an elevational view from one end thereof.
Figure 12:
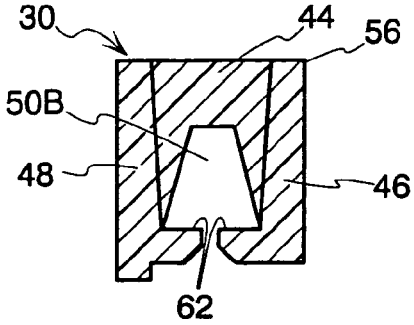
FIG. 12 is an elevational view from the other end thereof.

Turning now to FIGS. 5–8, and initially to FIG. 7, the dual opposed end stop formation generally designated at 220 has a width W which, in the preferred embodiment, ranges between ⅞ inch to 1½ inch. With the present invention, the width of end stops 68 (i.e., ½ of dimension W) can be made optimally small to allow maximum opening of the fastener tracks for easy access into the package. The height h of the end stop extending above the top of the fastener tracks ranges between 1/16–⅛ inch and is maximized for the best interference with the slider. The distance R across the bottom of the fastener tracks (see FIG. 3) is important to hold the slider on the tracks and it has been found important in many commercial applications that the full width R is maintained at the end stop. With reference to FIG. 2, the cross-section along line 6—6 occurs at the cut line which divides the dual end stop formation into respective end stop portions. The cross-sectional dimension or thickness at cross-section 6—6 is illustrated in FIG. 6 with reference to lateral dimension T. Also shown in FIG. 5 is the angular feature indicated by reference designator $\lambda$. This feature comprises an undercut where the upstanding portion of the FIG. 5 cross-section is joined to the relatively more massive base portion. With reference to FIG. 8, the upper fin portion 226 is defined with reference to a beveled surface 228 defined by an angular offset $\phi$.

Figure 3:
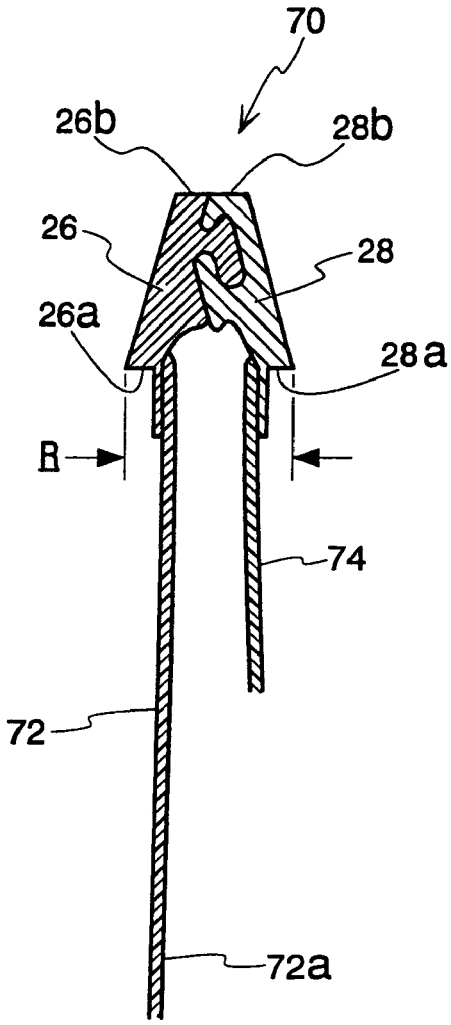
FIG. 3 is a cross-sectional view taken along the line 3—3 of FIG. 2.

With reference again to FIG. 2, an adjacent cross-section along line 5—5 is illustrated in FIG. 5. The width of the end stop at this section is indicated by reference designator S a dimension which preferably is held equal to or slightly greater than the dimension R of the undeformed fastener tracks as indicated in FIG. 3. With reference to FIG. 7 a fin-like flattened portion 224 is located between the finger-like extensions 220. The width of the flattened portion in the preferred embodiment, indicated by reference designator F is ¼ inch. At the upper end of the dual end stop formation, a corresponding fin-like portion 226 is provided between shoulders 208. It should be noted that the fin-like portions 224, 226 of reduced thickness are located along the severing line which divides the dual end stop formation into respective, opposed end stops. This reduces wear on the cutting member, and allows a lighter cutting stroke causing less disruption to the fastener track assembly. Further, the substantial reduction in thickness along the cut line provided by portion 224, 226 more closely resembles the thickness of the remainder to be cut, namely, the skirt or flange portions 72, 74. This allows a more even cutting across the entire extent of the zipper track assembly.

Turning now to FIGS. 3 and 13, and initially to FIG. 3, the fastener tracks are preferably formed from a sub-assembly generally indicated at 70 in which the fastener tracks 26, 28 are provided with corresponding fastener flanges 72, 74. The fastener flanges 72, 74 are co-extensive with the fastener tracks 26, 28 and take the form of a plastic web to be heat sealed to the panels 12, 14. As can be seen in FIG. 3, fastener flange 74 is shorter in height than fastener flange 72, so as to accommodate the preferred hermetic seal arrangement shown in FIG. 13. The fastener flanges 72, 74 are heat sealed to panels 12, 14. With reference to FIG. 13, fastener flange 72 is welded or otherwise mechanically sealed to panel 12 at weld band 78. As shown at the upper portion of FIG. 13, the upper ends of panels 12, 14 are joined to the outer outwardly facing surfaces of fastener flanges 72, 74 at points intermediate the fastener tracks and peelable seal 36. Band 36 preferably comprises an hermetic peelable seal formed by the joinder of panel 14 to the inside face 72*a* of fastener flange 72. Panel 12 is sealed to the opposite outside face of the fastener flange as schematically indicated in FIG. 13.

As indicated in FIG. 13, flanges 72, 74 are joined to respective panels 12, 14, preferably at their lower ends, so as to prevent product from entering between flange 72 and panel 12, as well as between flange 74 and panel 14. In certain applications this may not be a critical requirement. In FIG. 13, the upper portion of panel 12 is shown for illustrative purposes as spaced from the lower end of flange 72. In practice, it is generally preferred that this spacing be eliminated, with panel 12 being in intimate contact with flange 72. Similarly, any gap between panel 14 and the lower end of fastener flange 74 is preferably eliminated. Although it is most preferred that the peelable seal be formed by joining panel 14 to fastener flange 72, the peelable seal, preferably an hermetic seal, can be formed between the fastener flanges 72, 74 or directly between the panels 12, 14, although these alternative constructions are less preferred than the arrangement shown in FIG. 10.

Turning now to FIG. 13, flexible package 10 is shown constructed with the panels 12, 14, side seal 22, upper enlarged side seal portion 80 and fastener tracks 26, 28, as described above. FIG. 13 schematically illustrates a preferred commercial fabrication of flexible package 10. As will be appreciated by those skilled in the art, practical commercial assembly requires recognition of tolerances of the equipment and materials used to construct a viable commercial product. For example, tracks 26, 28 are ultimately mechanically coupled to panels 12, 14 using conduction heat seal tooling. It is preferred that the upper end of enlarged side seal portion 80 be spaced below the lower ends of the fastener tracks.

In one commercial embodiment, flexible package 10 comprises a plastic bag having a width of approximately 6.5 inches from side edge to side edge and a total overall height of approximately 10.75 inches. The fastener tracks 26, 28 have a height of approximately 4 millimeters. As shown in the upper left hand corner of FIG. 7, the stop projects a distance h above the top edge of the fastener tracks. Although the package opening, fastener tracks and related features are shown at the upper end of the flexible package, the present invention is intended to cover arrangements in which the opening and related structure is provided on the side or bottom of the flexible package.

The present invention is also directed to an improved package which includes the features of flexible package 10, described above and in addition includes a shroud portion such as a shroud portion which extends above line of weakness 208 formed in panels 12, 14. Preferably, the shroud is made for easy tear-away removal in an intuitive manual operation not requiring special directions. A notch may be formed in edge 18, located slightly above stop 68. In order to gain access to the package contents, a user grasps the upper edge of the shroud causing an initially tearing the notch. Tearing continues along a weakening line to a laser score line under the fastener tracks. With continued tearing across the width of the package, the shroud is removed, leaving a package substantially similar to the package described above in FIG. 1.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. A reclosable flexible package comprising:

opposed front and rear panels having sides and joined together to form an interior and a package opening communicating with said interior;

first and second interlockable fastener tracks configurable in an interlocked, closed position and an unlocked open position;

a slider at least partly extending above said fastener tracks and movable along said fastener tracks to configure said tracks in said interlocked position so as to close said opening and to configure said fastener tracks in said unlocked position so as to allow access through said opening to said package interior;

said fastener tracks having opposed ends located adjacent said opposed sides of said front and said rear panels;

a side seal of pre-selected width joining together one side of said front and said rear panels; and a stop adjacent said side seal formed from an end of said fastener tracks comprising an L-shaped shoulder having a portion extending above said fastener tracks and a finger-like portion lying below said shoulder.

2. The reclosable flexible package of claim 1 wherein said L-shaped shoulder includes a free-end facing away from said slider attached to a thin web-like fin portion and said finger-like portion including a free end with a thin web-like fin.

3. The reclosable flexible package of claim 2 wherein said finger-like protrusion is joined to the L-shaped shoulder of said stop by a web having an angled undercut at the point of joinder to said finger-like portion.

4. The reclosable flexible package of claim 1 wherein said finger-like portion comprises an undeformed continuous extension of the lower end of said fastener tracks.

5. The reclosable flexible package of claim 1 wherein said L-shaped shoulder has a major surface recessed with respect to said fastener tracks.

6. The reclosable flexible package of claim 1 wherein said L-shaped shoulder includes a beveled free-end facing away from said slider attached to a thin web-like fin portion and said finger-like portion including a free end with a thin web-like fin.

* * * * *

UNITED STATES PATENT AND TRADEMARK OFFICE

CERTIFICATE OF CORRECTION

PATENT NO. : 7,040,809 B2
APPLICATION NO. : 10/975567
DATED : May 9, 2006
INVENTOR(S) : Pokusa It is certified that error appears in the above-identified patent and that said Letters Patent is hereby corrected as shown below:

ON THE FACE OF THE PATENT:

On the face of the patent, item (62) should read as follows:

Division of application No. 10/280,335, filed on Oct. 25, 2002, now Pat. No. 6,884,207.

Signed and Sealed this

Twenty-second Day of August, 2006

JON W. DUDAS
*Director of the United States Patent and Trademark Office*